US006887016B1

(12) United States Patent
Skeels

(10) Patent No.: US 6,887,016 B1
(45) Date of Patent: May 3, 2005

(54) MUDMAT FOUNDATION FOR SUBSEA EQUIPMENT

(75) Inventor: Harold B. Skeels, Kingwood, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/687,305

(22) Filed: Oct. 15, 2003

(51) Int. Cl.[7] ..... E02D 5/00; E02B 17/02

(52) U.S. Cl. ..... 405/224; 405/226; 405/244; 405/203; 52/169.9; 248/171

(58) Field of Search ..... 405/224, 226, 405/244, 203, 204; 114/296; 52/169.6, 169.11; 248/156, 171

(56) References Cited

U.S. PATENT DOCUMENTS 4,273,471 A * 6/1981 Burke ..... 405/224
4,378,178 A * 3/1983 Roach ..... 405/224
4,666,112 A * 5/1987 Jaumann ..... 248/171
5,244,312 A * 9/1993 Wybro et al. ..... 405/204
5,722,796 A * 3/1998 Halvorsen et al. ..... 405/224
5,873,679 A * 2/1999 Cusimano ..... 52/169.9
6,354,767 B1 * 3/2002 Jones ..... 405/228
6,749,371 B2 * 6/2004 Jones ..... 405/232
2001/0045554 A1 * 11/2001 Pulliam ..... 256/65

* cited by examiner

*Primary Examiner*—Jong-Suk (James) Lee
(74) *Attorney, Agent, or Firm*—Henry C. Query, Jr.

(57) ABSTRACT

A mudmat foundation for supporting an item of subsea equipment on the sea floor comprises a mudmat on which the item of subsea equipment may be supported and a plurality of legs which are pivotably connected to and depend downwardly from the mudmat. The legs are free to pivot outwardly relative to the mudmat upon insertion of the legs into the sea floor to thereby increase the load bearing capacity of the mudmat.

20 Claims, 2 Drawing Sheets

MUDMAT FOUNDATION FOR SUBSEA EQUIPMENT

BACKGROUND OF THE INVENTION

The present invention is directed to a mudmat foundation for supporting subsea equipment on the sea floor. More particularly, the invention is directed to a mudmat foundation which comprises a mudmat and a depending umbrella structure that confines the soil beneath the mudmat and thereby increases the bearing capacity of the mudmat foundation.

Mudmats, conductor pipes and suction piles are common types of foundations which are used to support items of subsea equipment on the sea floor. The required size of a foundation for a given item of subsea equipment is in part a function of the bearing capacity of the soil at the sea floor, which is given by the following equation:

$$Q=faL+q_uA, \quad (1)$$

where Q is the bearing capacity of the soil, f is the skin friction factor of the soil, a is the perimeter area of the foundation, L is the penetration depth of the foundation, $q_u$ is the bearing strength of the soil, and A is the bearing footprint area of the foundation.

Often the bearing capacity of the soil is unknown, and in some instances the line of demarcation between the soil and the sea water is very undefined. Under these circumstances, the subsea equipment may sink into the sea floor and become lost. In addition, as shown by equation 1, any attempt to increase the bearing capacity of the soil typically involves increasing either the perimeter area of the foundation or the bearing footprint area of the foundation, or both. However, for poorly consolidated soils, the resulting foundation may be too large to pass through the moonpool of a drilling rig or too heavy to be lifted by the standard equipment on the drilling rig.

SUMMARY OF THE INVENTION

In accordance with the present invention, these and other disadvantages are overcome by providing a mudmat foundation for supporting an item of subsea equipment on the sea floor. The mudmat foundation comprises a mudmat on which the item of subsea equipment may be supported, a plurality of legs, and means for pivotably connecting an upper end of each leg to the mudmat. Thus, the legs are free to pivot outwardly relative to the mudmat upon insertion of the legs into the sea floor. Consequently, the legs will trap and consolidate the soil beneath the mudmat and thereby increase the load bearing capacity of the mudmat foundation.

The mudmat foundation may also comprise means for limiting the degree to which the legs may pivot. For example, the mudmat foundation may comprise a number of wire rope cables which each engage the legs to prevent the legs from pivoting beyond a predetermined angle.

In a preferred embodiment of the invention, the mudmat foundation also comprises a flexible cover which is attached to the legs or the cables, or both. In addition, the cover is ideally water permeable. In conjunction with the legs, the cover functions to further trap and consolidate the soil beneath the mud mat to thereby increase the load bearing capacity of the mudmat foundation.

These and other objects and advantages of the present invention will be made apparent from the following detailed description, with reference to the accompanying drawings.

DETAILED DESCRIPTION OF THE PREFERRED EMBODIMENTS

Figure 1:
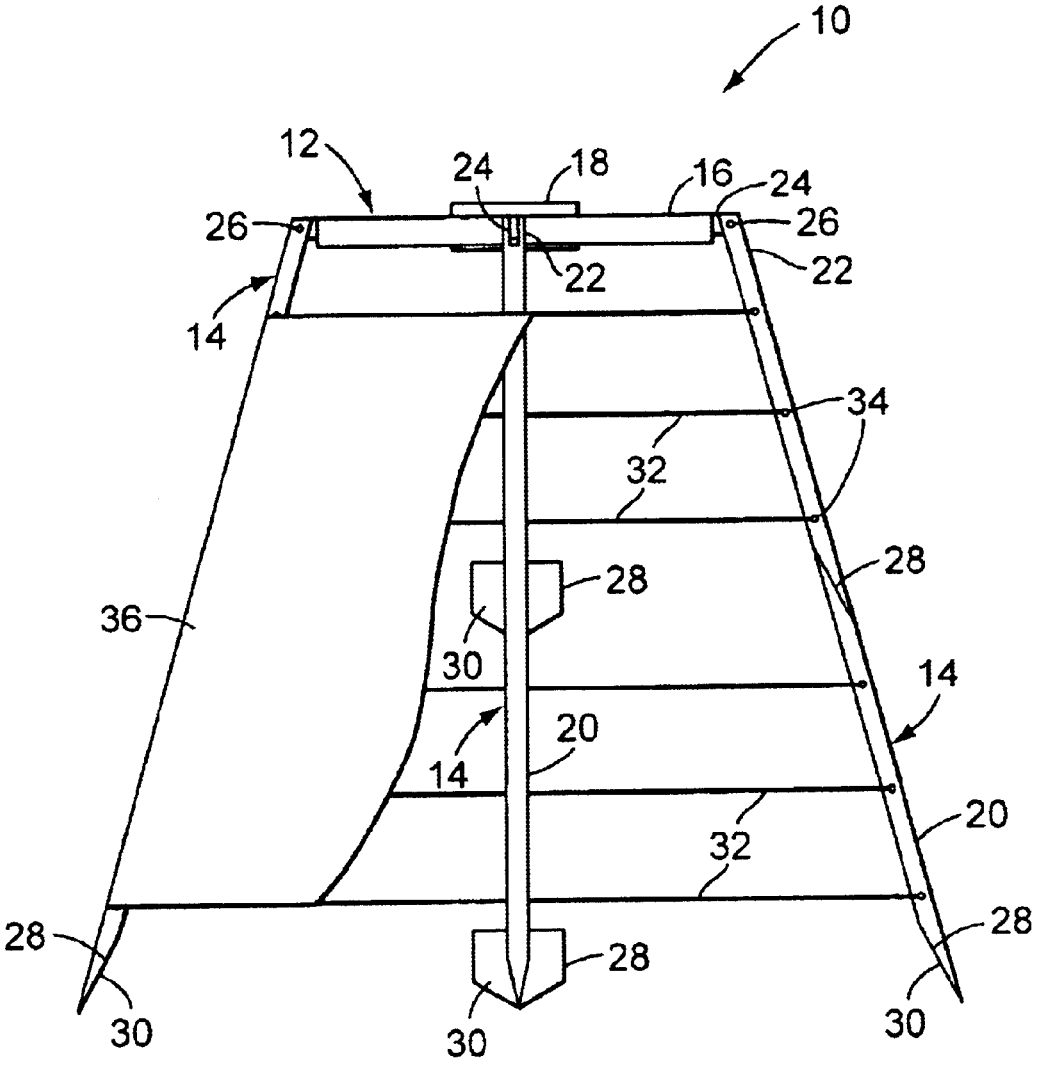
FIG. 1 is a front elevation view of the mudmat foundation of the present invention.

Referring to FIG. 1 the mudmat foundation of the present invention, which is indicated generally by reference number 10, comprises a mudmat 12 and a plurality of legs 14 which are pivotably connected to the mudmat. The mudmat 12 can comprise any convention mudmat which ideally includes a generally rectangular base 16 and a through bore 18 in which a conductor pipe or the like (not shown) may be secured.

The number of legs 14 which the mudmat foundation 10 comprises depends upon the size of the mudmat 12 and the conditions of the soil in which the mudmat foundation will be installed. In the embodiment of the invention shown in FIG. 1, for example, the mudmat foundation 10 comprises eight legs 14, one connected to each corner and the midpoint of each side of the base 16. For purposes of this description, the mudmat 12 and the legs 14 can be said to define an "interior" volume of the mudmat foundation which is disposed below the mudmat and between the legs.

Each leg 14 comprises an elongated post 20 which is comprised of, for example, metal tube stock. In addition, each post 20 includes an upper end 22 which is pivotally connected to a padeye 24 that in turn is attached to the base 16 of the mudmat 12, such as by welding. Consequently, each leg 14 is free to pivot outwardly relative to the mudmat 12 to thereby enlarge the interior volume of the mudmat foundation. In addition, the upper end 22 of each post 20 is preferably detachably connected to its corresponding padeye 24 by a removable pin or bolt 26. As a result, the legs 14 may be disassembled from the mudmat 12 by simply removing the pins 26.

Each leg 14 may also include a number of blades 28 which are secured to the post 20 such as by welding. Each blade 28 comprises a relatively broad face 30 which is positioned parallel to the pivot axis of the padeye 24 and ideally at an angle of, for example, between 10° and 30° relative to the longitudinal axis of the post 20. In this manner, as the legs 14 are inserted into the sea floor, the blades 28 will deflect the soil and urge the bottoms of the legs outwardly relative to the mudmat 12.

In a preferred embodiment of the invention, the mudmat foundation 10 may also comprise a number of lateral restraints 32 to limit the degree to which the legs 14 may pivot relative to the mudmat 12. In the exemplary embodiment of the invention shown in the Figures, each restraint 32 is shown to comprise a cable which is made of, for example, wire rope. In addition, each cable 32 may be connected to each leg 14 by being threaded through a corresponding hole 34 which is formed in the post 20. Furthermore, each cable 32 is ideally longer than the adjacent cable closer to the mudmat 12 so as to allow the bottoms of the legs 14 to pivot outwardly relative to the mudmat.

The mudmat foundation 10 ideally also comprises a cover 36 which is sized so as to enclose a substantial portion of the interior volume of the mudmat foundation. The cover 36 may be riveted or otherwise secured to the legs 14, the cables 32, or both, and may also extend to and be sealed to the mudmat 12. In a preferred embodiment of the invention, the cover 36 comprises a sturdy yet flexible and water permeable material, such as a plastic mesh type construction fabric. Such a fabric will contain and compress the soil within the interior volume of the mudmat foundation as the mudmat foundation 10 is being installed, but allow any water within the interior volume of the mudmat foundation to pass through into the surrounding environment.

When assembled as shown in FIG. 1, the legs 14 and any attached cables 32 and cover 36 form a collapsible "umbrella" structure which is preferably removably connected to the mudmat 12 by the pins 26. As will be described below, this umbrella structure may thus be collapsed during deployment and thereafter expanded during installation of the mudmat foundation in the sea floor.

Figure 2:
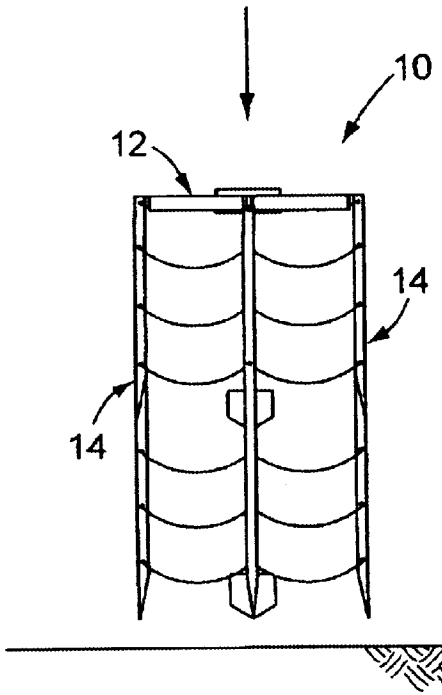
FIGS. 2 through 4 are sequential views of the mudmat foundation of FIG. 1 being installed in the seal floor, wherein the cover component of the invention has been omitted for clarity.
Figure 3:
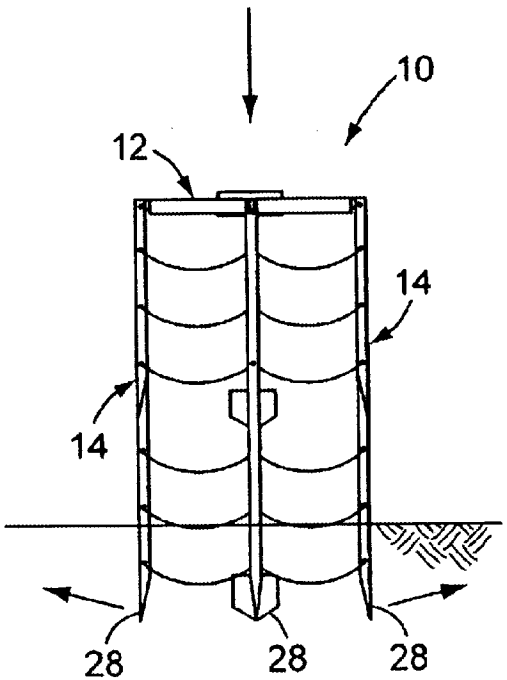
Figure 4:
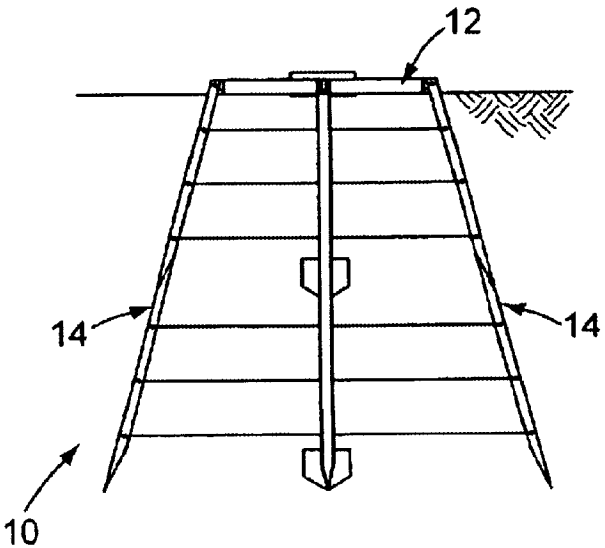

The installation of the mudmat foundation 10 will now be described with reference to FIGS. 2 through 4. Prior to installation, the mudmat foundation 10 may be partially disassembled by removing the legs 14 from the mudmat 12 in the manner described above. This will allow the legs 14 and any attached cables 32 and cover 36 to fold into a relatively small package which can be easily stored, transported and manipulated. In preparation for installation, the mudmat 12 is set in the moonpool of a drilling rig or the like and the legs 14 are connected to the padeyes 24 with the pins 26. In this configuration, which is shown in FIG. 2, the legs 14 extend generally vertically from the mudmat 12 and therefore do not add substantially to the lateral dimensions of the mudmat foundation 10. Consequently, the mudmat foundation 10 may be readily assembled in and lowered through the moonpool.

The mudmat foundation 10 may be lowered from the drilling rig on a cable or drill pipe which is connected to the mudmat 12. As the mudmat foundation 10 is lowered, the legs 14 will remain generally vertical. However, as the legs 14, and in particular the blades 28, contact the soil on the sea floor, the legs 14 will deflect the soil and begin to pivot radially outwardly relative to the mudmat 12, as shown in FIG. 3. As the mudmat foundation 10 is lowered further, the legs 14 will continue to pivot radially outwardly until the cables 32 become taut. If the cover 36 is employed, further lowering of the mudmat foundation 10 will consolidate the soil by expelling any water from the interior volume of the mudmat foundation. Thus, once the mudmat 12 reaches its final resting position on the sea floor, which is shown in FIG. 4, the legs 14 and the cover 36 will have captured a very large volume of soil which will add to the bearing capacity of the mudmat foundation 10 by greatly increasing the total mass which must be moved when the mudmat foundation is subjected to loads.

The mudmat foundation 10 may be recovered from the sea floor by simply lifting the mudmat 12 vertically. This will pull the legs 14 out of the sea floor and permit the entire mudmat foundation 10 to be retrieved to the drilling rig. Alternatively, the mudmat 12 can be disconnected-from the legs by removing the pins 26. In this scenario, the mudmat 12 is retrieved to the drilling rig while the legs 14 and any attached cables 32 and cover 36 are left in the sea floor.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A mudmat foundation for supporting an item of subsea equipment on the sea floor, the mudmat foundation comprising:

a mudmat on which the item of subsea equipment may be supported; and a plurality of legs which are pivotably connected to and depend downwardly from the mudmat and which are inserted into the seal floor as the mudmat is lowered into position on the sea floor;

wherein the legs are free to pivot outwardly relative to the mudmat upon insertion of the legs into the sea floor.

2. The mudmat foundation of claim 1, wherein each leg comprises an elongated post having an upper end that is pivotably connected to the mudmat along a respective pivot axis.

3. The mudmat foundation of claim 2, wherein each leg further comprises at least one blade which is connected to the post.

4. The mudmat foundation of claim 3, wherein the blade comprises a face which is positioned generally parallel to the pivot axis.

5. The mudmat foundation of claim 4, wherein the face is also positioned at an acute angle relative to the longitudinal axis of the post.

6. The mudmat foundation of claim 5, wherein the face is positioned at an angle of between approximately 10° and 30° relative to the longitudinal axis of the post.

7. The mudmat foundation of claim 2, further comprising a plurality of padeyes which are attached to the mudmat and means for pivotably connecting the upper end of each post to a corresponding padeye.

8. The mudmat foundation of claim 7, wherein the connecting means comprises a pin or bolt.

9. The mudmat foundation of claim 8, wherein the pin or bolt is removable.

10. The mudmat foundation of claim 1, further comprising means for limiting the degree to which the legs may pivot.

11. The mudmat foundation of claim 10, wherein the limiting means comprises at least one cable which engages the legs.

12. The mudmat foundation of claim 11, wherein the limiting means comprises a plurality of cables which each engage the legs.

13. The mudmat foundation of claim 12, wherein each cable is longer than an adjacent cable closer to the mudmat.

14. The mudmat foundation of claim 13, wherein each cable is threaded through a corresponding hole in each of the legs.

15. The mudmat foundation of claim 1, further comprising a flexible cover which is attached to the legs and which is expandable upon the outward pivoting of the legs.

16. The mudmat foundation of claim 15, wherein the cover is water permeable.

17. A mudmat foundation for supporting an item of subsea equipment on the sea floor, the mudmat foundation comprising:

a mudmat on which the item of subsea equipment may be supported;

a plurality of legs which are inserted into the seal floor as the mudmat is lowered into position on the sea floor;

means for pivotably connecting an upper end of each leg to the mudmat;

wherein the legs are free to pivot outwardly relative to the mudmat upon insertion of the legs into the sea floor; and means for limiting the degree to which the legs may pivot.

18. The mudmat foundation of claim 17, wherein the limiting means comprises a number of cables which each engage the legs.

19. The mudmat foundation of claim 18, further comprising a flexible cover which is attached to at least one of the cables or the legs and which is expandable upon the outward pivoting of the legs.

20. The mudmat foundation of claim 19, wherein the cover is water permeable.

* * * * *